US012258721B2

(12) United States Patent
Argall et al.

(10) Patent No.: US 12,258,721 B2
(45) Date of Patent: Mar. 25, 2025

(54) SUBSEA ANCHORAGE INSTALLATION SYSTEM

(71) Applicant: Makai Ocean Engineering, Inc., Waimanalo, HI (US)

(72) Inventors: Richard Samuel Kelway Argall, Kailua, HI (US); Donald Casela Lasser, Honolulu, HI (US); Gregory John Rocheleau, Honolulu, HI (US)

(73) Assignee: Makai Ocean Engineering, Inc.

( * ) Notice: Subject to any disclaimer, the term of this patent is extended or adjusted under 35 U.S.C. 154(b) by 0 days.

(21) Appl. No.: 18/329,361

(22) Filed: Jun. 5, 2023

(65) Prior Publication Data

US 2023/0304248 A1 Sep. 28, 2023

Related U.S. Application Data

(63) Continuation of application No. 17/694,314, filed on Mar. 14, 2022, now Pat. No. 11,713,552.

(60) Provisional application No. 63/160,385, filed on Mar. 12, 2021.

(51) Int. Cl.
*E02B 17/00* (2006.01)

(52) U.S. Cl.
CPC ..... *E02B 17/0008* (2013.01)

(58) Field of Classification Search
CPC ..... E02B 17/0008
See application file for complete search history.

(56) References Cited

U.S. PATENT DOCUMENTS 3,999,499 A * 12/1976 Kitabayashi ..... B63G 8/42 114/244
6,325,158 B1 12/2001 Rangnes et al.
7,044,685 B2 5/2006 Wybro et al.
9,656,800 B2 * 5/2017 Donahue ..... B65D 88/78
9,850,046 B2 12/2017 Stanley et al.
(Continued)

FOREIGN PATENT DOCUMENTS

CN 106015736 A 10/2016
WO 2012/123431 A1 9/2012
WO 2020/038703 A1 2/2020

OTHER PUBLICATIONS

International Search Report and Written Opinion received from the Korean Intellectual Property Office issued in related International Patent Application No. PCT/US2022/020232 mailed Jun. 23, 2022 (9 pages).

(Continued)

*Primary Examiner* — Janine M Kreck
(74) *Attorney, Agent, or Firm* — THE MARBURY LAW GROUP, PLLC

(57) ABSTRACT

Various aspects include devices, systems, and methods for securing an anchoring element to a seafloor. The methods may use a subsea anchorage installation system that may include a subsea grout supply assembly. The subsea grout supply assembly may include a variable volume grout storage chamber, a paddle, and a subsea grout pump. The variable volume grout storage chamber may be configured to transport dry grout to a seafloor. The variable volume grout storage chamber may include a water injection port configured to receive water for mixing with the dry grout on the seafloor. The variable volume grout storage chamber may also be configured to expand from a collapsed configuration as water is injected.

21 Claims, 10 Drawing Sheets

(56) References Cited

U.S. PATENT DOCUMENTS

| | | | | |
|---|---|---|---|---|
| 10,035,942 | B2 | 7/2018 | Biddle et al. | |
| 11,713,552 | B2 * | 8/2023 | Argall | E02D 27/525 405/225 |
| 2010/0119309 | A1 | 5/2010 | Gibberd | |
| 2011/0293379 | A1 | 12/2011 | Halkyard et al. | |
| 2014/0161538 | A1 | 6/2014 | Meggitt et al. | |
| 2016/0153260 | A1 | 6/2016 | Brothers et al. | |
| 2019/0169957 | A1 | 6/2019 | Hatalsky et al. | |

OTHER PUBLICATIONS

International Preliminary Report on Patentability (Chapter 1 of the Patent Cooperation Treaty) and Written Opinion of the International Searching Authority issued in corresponding International Application No. PCT/US2022/020232 mailed Sep. 21, 2023.

* cited by examiner

SUBSEA ANCHORAGE INSTALLATION SYSTEM

RELATED APPLICATIONS

This application claims priority to U.S. Non-Provisional patent application Ser. No. 17/694,314 entitled "Subsea Anchorage Installation System," filed Mar. 14, 2022, which claims the benefit of priority to U.S. Provisional Patent Application No. 63/160,385 entitled "Remote Anchorage Installation System" filed Mar. 12, 2021, the entire contents of both of which are hereby incorporated by reference for all purposes.

BACKGROUND

Traditional methods of anchoring and mooring bodies to the seafloor include large and heavy anchors or piles to provide the strength needed to restrain the bodies. These anchoring and mooring systems provide both the ballast to overcome a body's buoyancy, and lateral stability to maintain the body's position on the seafloor in dynamic waters to overcome waves and currents. These anchoring and mooring systems are currently used throughout the marine construction industry, including floating and submerged marine renewable energy systems, offshore pipelines, offshore structures, including for the oil and gas industry, and subsea infrastructure.

The downsides to traditional anchoring and mooring systems include the cost and size of these systems, the support equipment needed, and the environmental impact of installation. The cost of building and installing large anchors and moorings is high and often encompasses a large portion of offshore development costs. The size and weight of many traditional anchoring and mooring systems require large support vessels and specialty equipment to transport and install them. The availability of such support equipment is often limited and desirable throughout the marine construction industry, which tends to raise project costs and may cause delays. Installation of many of these systems requires dredging of large areas on the seafloor that poses an environmental hazard to the surrounding waters.

Micropiles are a small, lightweight, and strong alternative for foundational support. Prior to installation in the ground or seafloor, micropiles are formed to have a hollow annulus that is configured to be filled with grout. Installing micropiles for subsea applications is done by using drill rigs that are equipped for subsea use. These systems are deployed from a surface vessel, but require additional support equipment and materials to be sent to the seafloor with the rig and typically require diver support. The grout used to install micropiles is mixed on the surface support vessel and pumped from the support surface vessel to the subsea drill rig to fill the micropiles with grout.

SUMMARY

Various embodiments include a subsea anchorage installation system for securing an anchoring element to a seafloor. The subsea anchorage installation system may include a subsea grout supply assembly that includes a variable volume grout storage chamber, a paddle, and a subsea grout pump. The variable volume grout storage chamber may be configured to transport dry grout to the seafloor. The variable volume grout storage chamber may also be configured to expand from a collapsed configuration. The variable volume grout storage chamber may include a water injection port configured to receive water for mixing with the dry grout. The paddle may be disposed in the variable volume grout storage chamber. The paddle may be configured to mix the dry grout and water received through the water injection port into a grout mixture. The subsea grout pump may be configured to pump the grout mixture out of the variable volume grout storage chamber into the anchoring element at the seafloor.

In some embodiments, the variable volume grout storage chamber may include upper and lower sections. The upper section may be formed with a flexible bladder and the lower section may be formed with rigid side walls, in which only the upper section of the upper and lower sections is configured to expand and contract. The subsea grout supply assembly may further include a mixing motor configured to drive the paddle.

In some embodiments, the subsea anchorage installation system may further include a subsea drill rig. The subsea drill rig may include a drill mast, a drill head, and a plume hood. The drill mast may be configured to be raised to a select drill angle. The drill head may be coupled to the drill mast. The drill head may be configured to drill the anchoring element into the seafloor at a drill location. The plume hood may be coupled to the drill head. The plume hood may be configured to collect sediment generated in association with drilling the anchoring element into the seafloor.

In some embodiments, the subsea anchorage installation system may further include a plume capture assembly. The plume capture assembly may include an eductor, a water filter, and a water pump. The eductor may be configured to remove sediment particulates flushed from a drill location of the anchoring element. The water filter may be configured to remove sediment and particulates from a water stream. The water pump may be configured to direct the water stream to pass through the water filter.

In some embodiments, the dry grout may be mixed with seawater from the surrounding water to the subsea grout supply assembly. Alternatively, the dry grout may be mixed with fresh water supplied from a subsea container. The subsea grout supply assembly may withstand and be operated at ocean depths of fifty meters or more. The subsea grout supply assembly may be configured to be self-propelled at the seafloor. For example, the subsea grout supply assembly may be configured to move itself along the seafloor using motors and treads or wheels. Alternatively or additionally, the subsea grout supply assembly may be configured to propel itself using thrusters and buoyancy control.

Various embodiments include a method of installing anchoring elements in the seafloor. The method may include transporting dry grout to a seafloor in a variable volume grout storage chamber. The dry grout may be maintained dry at the seafloor within the variable volume grout storage chamber. The method may also include mixing the dry grout and water to form a grout mixture within the variable volume grout storage chamber at the seafloor. Additionally, the method may include pumping the grout mixture from the variable volume grout storage chamber at the seafloor to a subsea drill rig at a drill location.

In some embodiments the method may further include expanding the variable volume grout storage chamber and injecting water into the expanded variable volume grout storage chamber. In some embodiments the injected water may be seawater from the area around a drilling location at the seafloor. In some embodiments the injected water may be fresh water that is other than seawater. In some embodiments, the variable volume grout storage chamber may be contracted as the grout mixture is pumped out thereof.

In some embodiments, the method may further include drilling an anchoring element into the seafloor at the drill location to a select depth. In response to drilling the anchoring element to the select depth, pumping the grout mixture from the variable volume grout storage chamber at the seafloor to the subsea drill rig at the drill location may include pumping the grout mixture to the anchoring element. In some embodiments, the method may further include inserting a casing into the seafloor. Thus, drilling the anchoring element into the seafloor may be in response to inserting the casing into the seafloor. The anchoring element may be inserted through the casing to be drilled into the seafloor.

BRIEF DESCRIPTION OF THE DRAWINGS

The accompanying drawings, which are incorporated herein and constitute part of this specification, illustrate example aspects of various embodiments, and together with the general description given above and the detailed description given below, serve to explain the features of the claims.

DETAILED DESCRIPTION

Figure 1A:
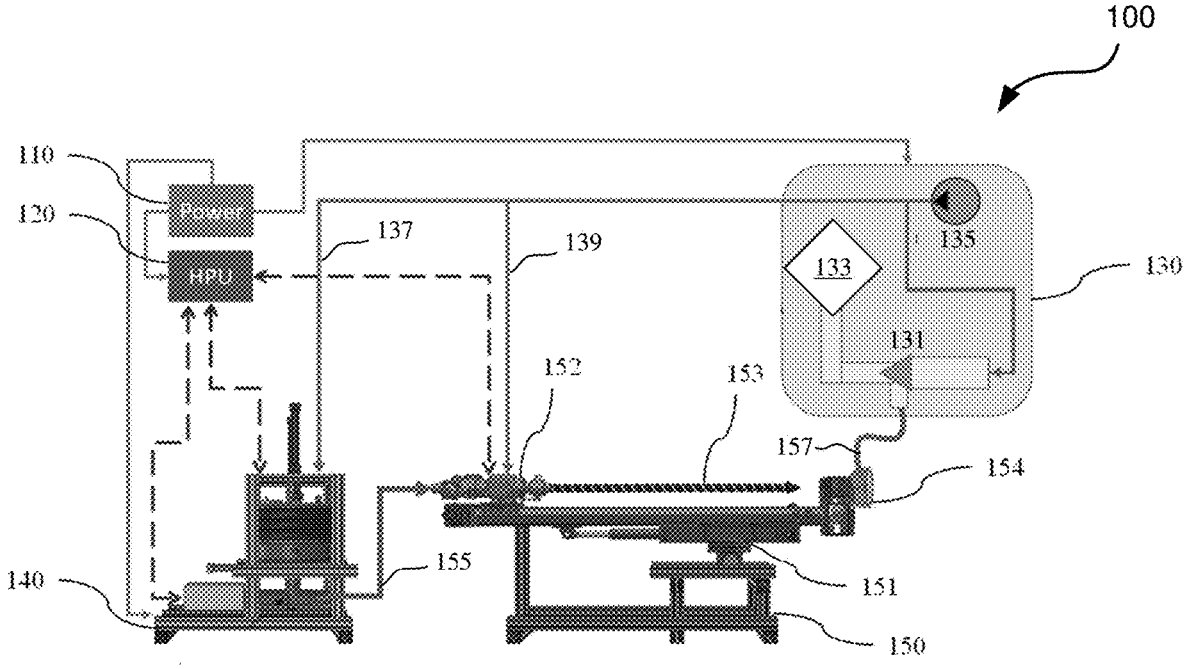
FIGS. 1A and 1B are schematic diagrams of a subsea anchorage installation system in accordance with various embodiments.

Various embodiments will be described in detail with reference to the accompanying drawings. Wherever possible, the same reference numbers will be used throughout the drawings to refer to the same or like parts. References made to particular examples and implementations are for illustrative purposes and are not intended to limit the scope of the claims.

Various embodiments described herein relate to subsea anchorage installation systems and methods, and more particularly to micropiling and subsea grout mixing and pumping, which may lower cost as compared to existing installation methods. In particular, various embodiments include hardware that allows dry grout and water to be mixed on the seafloor at or near a drill location. A customized storage chamber may prevent dry grout from mixing with water as it is transported to the seafloor with a subsea drill rig. Once the subsea drill rig has been positioned at the drill location, a control system may raise and position a drill mast of the subsea drill rig at a desired drill angle. The subsea drill rig may then begin to drill into the seafloor using an anchoring element (e.g., a micropile), while flushing the drill hole with water, slurry, or other fluids. The water, slurry, or other fluids may be injected through a hollow portion of the anchoring element itself, such as the bore of a micropile. The drilling and fluid injection may create a sediment plume, which may be collected using a plume hood. The plume of sediment collected by the plume hood may then be sent through a plume capture assembly that filters the sediment-water mixture and separates out any plume particulates. The filtered water may then be reused, such as by being sent back through the subsea drill rig for fluid injection or sent to the subsea grout supply to mix with the grout. Once the anchoring element (e.g., the micropile) has reached a specified depth, drilling may stop, and grout mixing may begin. The grout mixing may include adding water through water injection ports to the dry grout that was transported to the seafloor. The water injection ports may be located at the top, bottom, and/or sides of a variable volume grout storage chamber. Various embodiments may include using seawater from the surroundings or fresh water sent with the subsea drill rig to mix with the dry grout. As water is injected into the grout mixture, the variable volume grout storage chamber expands, and the upper and lower mixing motors begin mixing the grout mixture with the internal mixing paddles. Once the grout mixture has been properly mixed, the bladder may be compressed and the grout mixture pumped through the hollow portion of the anchoring element to fill the drill hole and set the anchoring element into the seafloor. Once the grout mixture has been pumped into the drill location, the anchoring element may be released from the subsea drill rig and the subsea drill rig recovered, or moved to another anchoring location.

In some embodiments, an anchoring element may be drilled into the seafloor at the drill location to a select depth in the sea floor. In response to drilling the anchoring element to the selected depth, the grout mixture may be pumped from the variable volume grout storage chamber at the seafloor to the subsea drill rig at the drill location. In particular, the grout mixture may be pumped into the anchoring element.

In some embodiments a casing may be initially inserted into the seafloor through a layer of soft substrate that extends from the uppermost layer of the seafloor to a harder sub-bottom substrate layer suitable for grouted anchoring elements. Casings may be drilled in, hammered in, or screwed in via numerous means. In some embodiments, drilling the anchoring element into the seafloor may be in response to inserting the casing into the seafloor. The anchoring element may be inserted through the casing to be drilled into the seafloor.

Various embodiments include a method of remotely installing micropiles on the seafloor that includes methods of mixing, and pumping grout on the seafloor. A subsea drill rig and subsea grout supply assembly may be sent to the seafloor with all supporting materials and equipment, such that no additional materials need to be sent to the seafloor once the installation has begun. Once the subsea drill rig and the subsea grout supply assembly have been placed at or near the drill location, the drill mast may be raised and drilling may begin. Any dust plume generated from drilling may be contained by a plume capture hood over the drill location. A seawater pump may build negative pressure in the plume capture hood that pulls water through a hollow interior of the anchoring element and flushes the drill location of particulates. The water and particulate stream is then sent to a water filtration system. The filtration system may filter out all plume particulates and stores them on the rig until retrieved by a support vessel.

The subsea drill rig and the subsea grout supply assembly may be sent to the seafloor with a set volume of dry grout that is needed to install the anchoring element(s). Once an anchoring element is drilled into the seafloor, water may be added to the dry grout through the water injection ports on the top, bottom, and sides of the variable volume grout storage chamber. In some embodiments, the system will use seawater to mix the grout, and in other embodiments fresh water. The fresh water may be contained on the subsea drill rig and used to mix the grout. The subsea grout mixing hardware may include a variable volume bladder that contains the grout mixture during subsea mixing and pumping. The variable volume grout storage chamber may be deployed to the seafloor with the bladder collapsed surrounding the dry grout. This reduces the size and weight of the subsea grout supply assembly during deployment. The volume of the bladder may be controlled by linear actuators that expand and contract the bladder during mixing and pumping respectively. Upper and lower mixing paddles may be driven by hydraulic motors and may be used to thoroughly mix the grout, such that once water is added to the grout, mixing commences. The grout mixture may then be pumped through the a hollow micropile using a piston pump at the bottom of the grout mixer, and the volume of the bladder may be compressed with the linear actuators.

Various embodiments further include methods of installing micropiles in the seafloor as summarized above.

As used herein, the term "anchoring element" refers to an elongate durable foundation element that may be secured in a bore hole and is configured to receive a grout and/or resin mixture therein. For example, an anchoring element may include a "micropile," which refers to a small diameter metal tubular element, that may be drilled into the seafloor (i.e., the seabed). Micropiles are also referred to as mini-piles, pin-piles, root-piles and are generally high-strength, durable small diameter (e.g., ~1-12" (25-300 mm) steel casing pile, rib, or bar configured to be drilled into a bore hole and filled with high strength cement grout and/or resin. An anchoring element may also be an elongate solid form configured to be drilled into a bore hole, with grout and/or resin applied directly into the annulus around the anchoring element to effect fixation. Anchoring elements may be metal, plastic, composite, and/or concrete. Anchoring elements may be drilled into a bore hole or placed into a pre-drilled seabed rock socket.

Figure 1B:
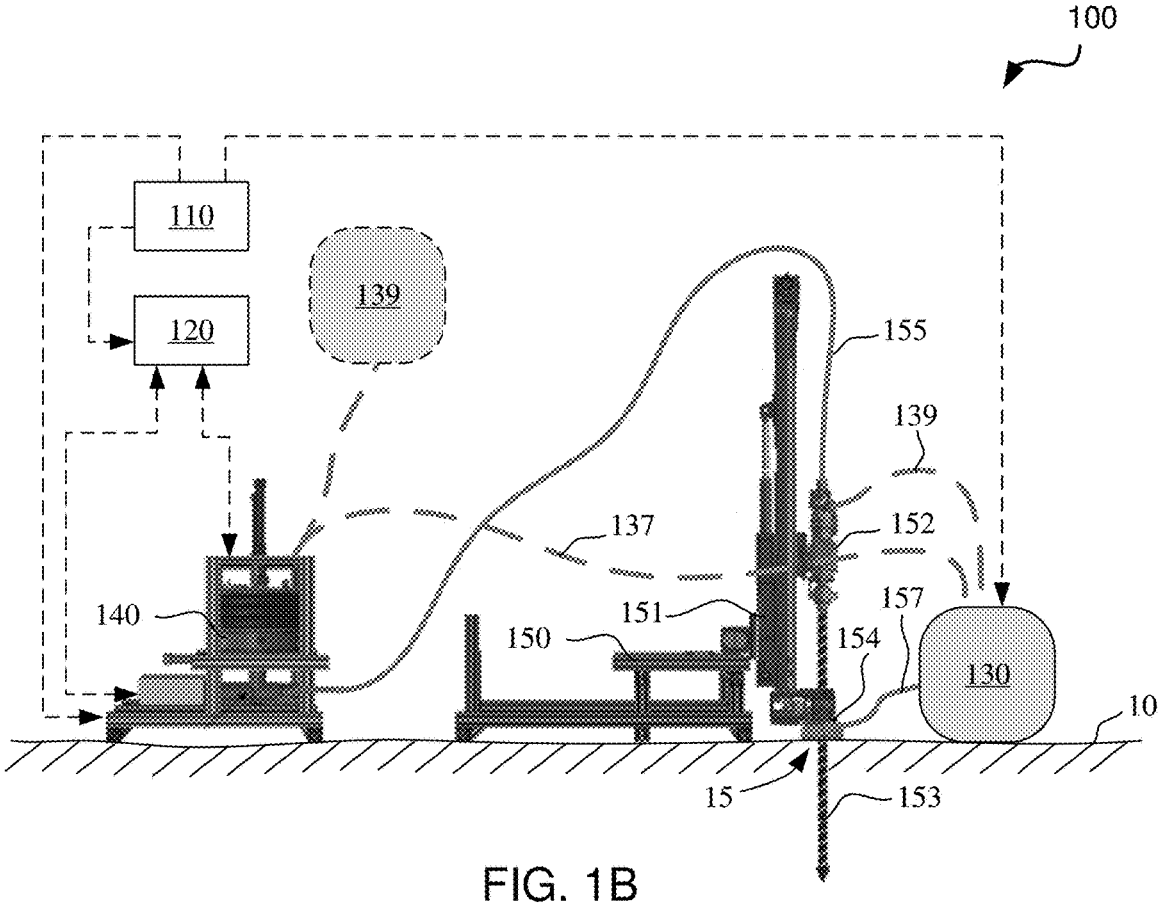
Figure 2A:
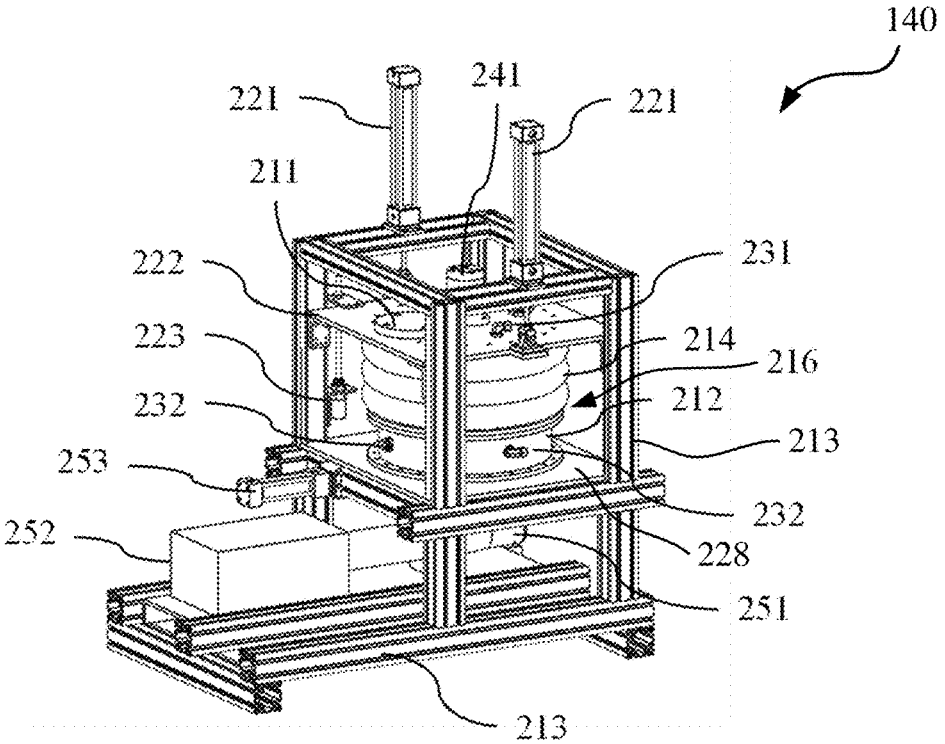
FIG. 2A is an isometric view of a subsea grout supply assembly in accordance with various embodiments.
Figure 2B:
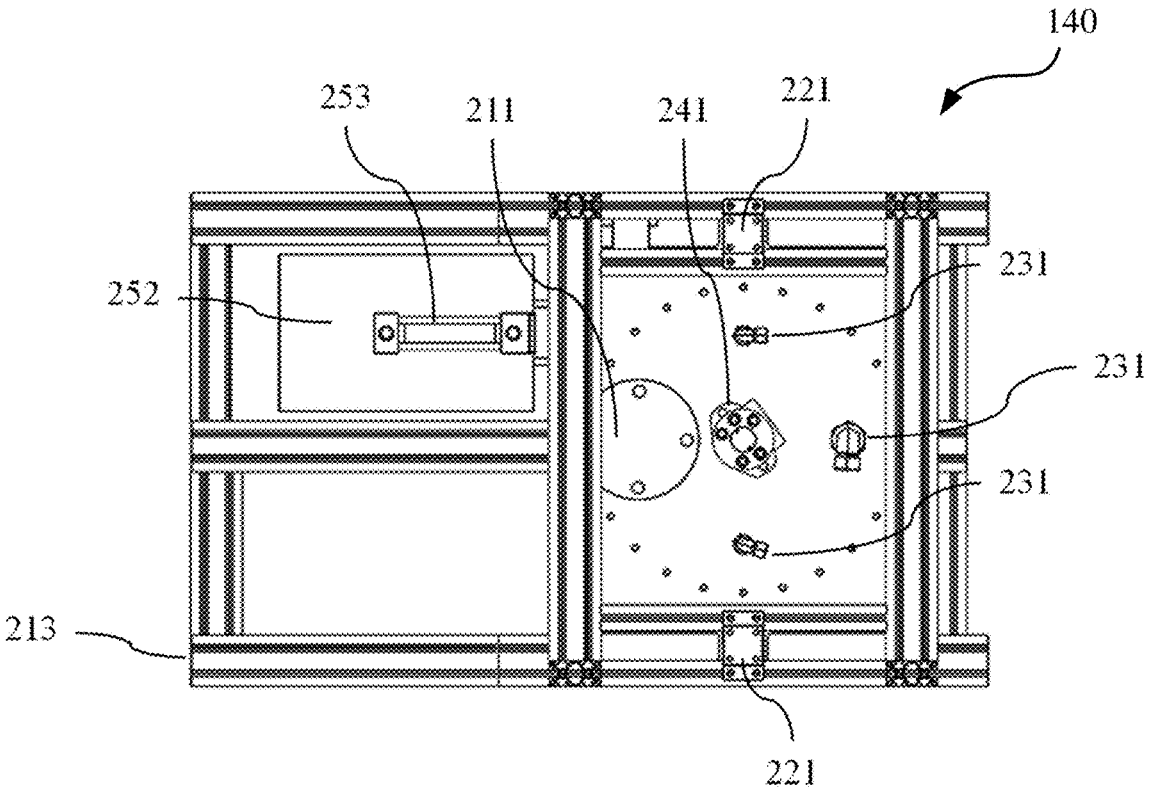
FIG. 2B is a top view of the subsea grout supply assembly of FIG. 2A, in accordance with various embodiments.
Figure 2C:
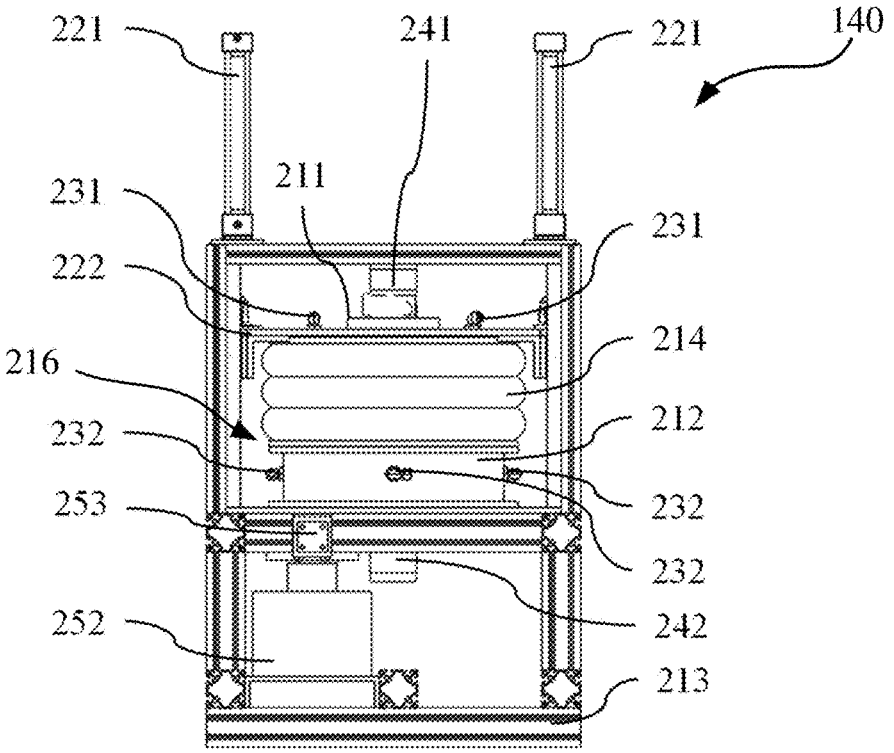
FIG. 2C is a front view of the subsea grout supply assembly of FIGS. 2A and 2B, in accordance with various embodiments.
Figure 2D:
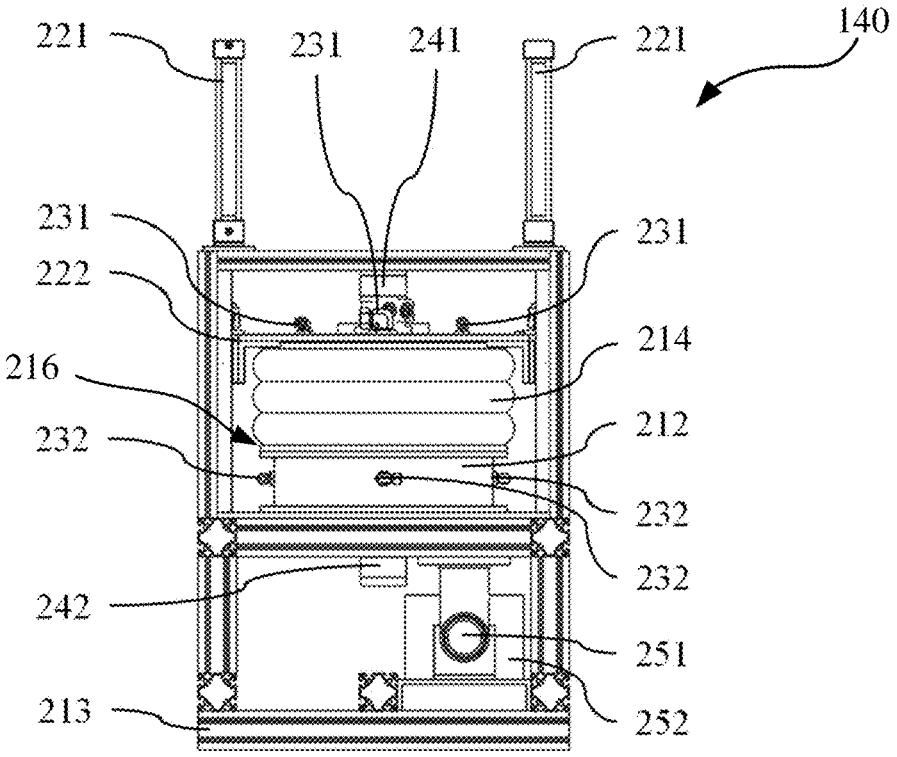
FIG. 2D is a rear view of the subsea grout supply assembly of FIGS. 2A-2C, in accordance with various embodiments.

FIGS. 1A and 1B illustrate a subsea anchorage installation system 100, in accordance with various embodiments. The subsea anchorage installation system 100 may include a subsea grout supply assembly 140 that is configured to transport dry grout to the seafloor 10 and then mix the dry grout with water when needed for subsea anchoring. The subsea grout supply assembly 140 may be configured to work in conjunction with subsea drill rigs, such as the subsea drill rig 150. In particular, the subsea grout supply assembly 140 may be configured to supply one or more subsea drill rigs with mixed grout. Also, the subsea grout supply assembly 140 may be supplied water from various sources, such as the plume capture assembly 130. The water may be used to convert dry grout into a wet grout mixture. Alternatively, the subsea grout supply assembly 140 may receive water from a separate water pumping unit, which may be similarly submerged, located on a surface level vessel, or elsewhere. In addition, the subsea anchorage installation system 100 may additionally include a power supply 110 and optionally a hydraulic power unit (HPU) 120, which may be used to control the subsea grout supply assembly 140. The power supply 110 may power components of the subsea grout supply assembly 140. The optional HPU 120 may be used for mechanical actuators included in the subsea grout supply assembly 140 that are not otherwise powered by the power supply 110. Further details relating to the subsea grout supply assembly 140 are described below with regard to FIGS. 2A-3.

In various embodiments, the subsea anchorage installation system 100 may additionally include a subsea drill rig 150 that is configured to work in conjunction with the subsea grout supply assembly 140. The subsea drill rig 150 may be used to drill a bore hole, bury anchoring elements, such as a micropile, in the sea floor 10, and secure the anchoring elements in the seafloor 10 with mixed grout supplied by the subsea grout supply assembly 140. The subsea drill rig 150 may include a drill mast 151, a drill head 152, and a plume hood 154. The drill mast 151 may be configured to tilt to a desired angle. A tilting actuator may be included that controls the tilt angle of the drill mast 151. Once the drill mast 151 is tilted to the desired angle, the drill head 152 may be configured to drill an anchoring element 153 (e.g., a micropile) into the seafloor. Various embodiments may include a hydraulic cylinder to tilt (i.e., raise) the drill mast 151. FIG. 1A illustrates the drill mast 151 tilted to a horizontal position, which may be particularly used for moving and/or transporting the subsea drill rig 150. FIG. 1B illustrates the drill mast 151 raised to a vertical position in order to aim the anchoring element 153 toward the seafloor 10 at a desired angle for the anchoring element 153 to penetrate at a drilling location 15. Although FIG. 1B illustrates the drill mast 151 tilted to a 90-degree angle (i.e., vertical), other desired drilling angles may be achieved.

Once the drill mast 151 is aiming at the appropriate drilling location 15 and at the desired angle, the drill head 152 may rotate the anchoring element 153, similar to a drill bit. The drill head 152 may also be powered to ride down a rail of the drill mast 151, in order to advance (i.e., drill) the anchoring element 153 into the seafloor 10. Movement of the drill head 152 along the mast rail may be controlled by a separate actuator. During the drilling process, an environmental sediment plume may be generated from the sediment on the seafloor 10 that kicks up. Thus, in various embodiments the plume hood 154 may be configured to capture the environmental sediment plume and redirect the captured sediment to a plume capture assembly 130 for filtering the water and removing the sediment. The power supply 110 may power components of the subsea drill rig 150 (e.g., the tilting or other actuators and/or the drill head 152). Also, the optional HPU 120 may be used for mechanical actuators included in the subsea drill rig 150 that are not otherwise powered by the power supply 110 (e.g., the tilting actuator and/or the drill head 152). Once the anchoring element 153 is drilled into the seafloor 10 to an appropriate depth, the subsea drill rig 150 may be ready to receive mixed grout from the subsea grout supply assembly 140, which may be supplied through a grout supply line 155.

In various embodiments, the subsea anchorage installation system 100 may further include a plume capture assembly 130, which may be configured to supply the subsea grout supply assembly 140 with water (e.g., for mixing grout) through a grout-water supply line 137. Alternatively or additionally, the plume capture assembly 130 may be configured to supply water to the subsea drill rig 150 through a drill-water supply line 139. In accordance with various embodiments, the water supplied by the plume capture assembly 130 may be captured from an environmental sediment plume that may be created during drilling.

In order to capture the environmental sediment plume, the plume capture assembly 130 may include an eductor 131, a water filter 133, and a water pump 135. The eductor 131 may be configured to remove sediment particulates flushed from a drill location 15 of the anchoring element 153. The eductor 131 takes advantage of the nature of fluid dynamics to separate water from sediment laden therein. Using negative pressure supplied by the water pump 135, the eductor 131 may draw-in water mixed with sediment in order to separate the two. In addition, by coupling the eductor 131 to the plume hood 154 on the subsea drill rig 150, via a plume capture line 157, an environmental sediment plume may be drawn into the plume hood 154, through the plume capture line 157, and through the eductor 131. In this way, the eductor 131 may be used to provide a first level of separating the water from the sediment.

Additional levels of sediment may be removed from the water by using pressure provided by the water pump 135 to force the water drawn-in by the eductor 131 through the water filter 133. The water pump 135 may be a mechanical device that converts mechanical torque into hydraulic energy. The water pump 135 may facilitate movement of fluids (i.e., water and/or water with sediment) from one place to another using suction or pressure or both. The water pump 135 may be driven by a water pump motor, which may be an electro-mechanical device that are used to convert electrical energy into mechanical energy. Alternatively, the water pump motor may be driven by the HPU (e.g., 120).

The water filter 133 may be configured to remove further sediment and particulates from a water stream. The water filter 131 may include a series of filters. The series of filters may be configured to separate increasingly smaller sizes of sediment and particulates from the water passing through them.

Unlike conventional micropile drilling systems, all components of the subsea anchorage installation system 100 may be configured to operate under water at the drill location, thus eliminating the need to mix and pump the grout from the support vessel on the water's surface to the drill location. This will reduce complexity and cost of subsea anchorage installation.

Figure 1C:
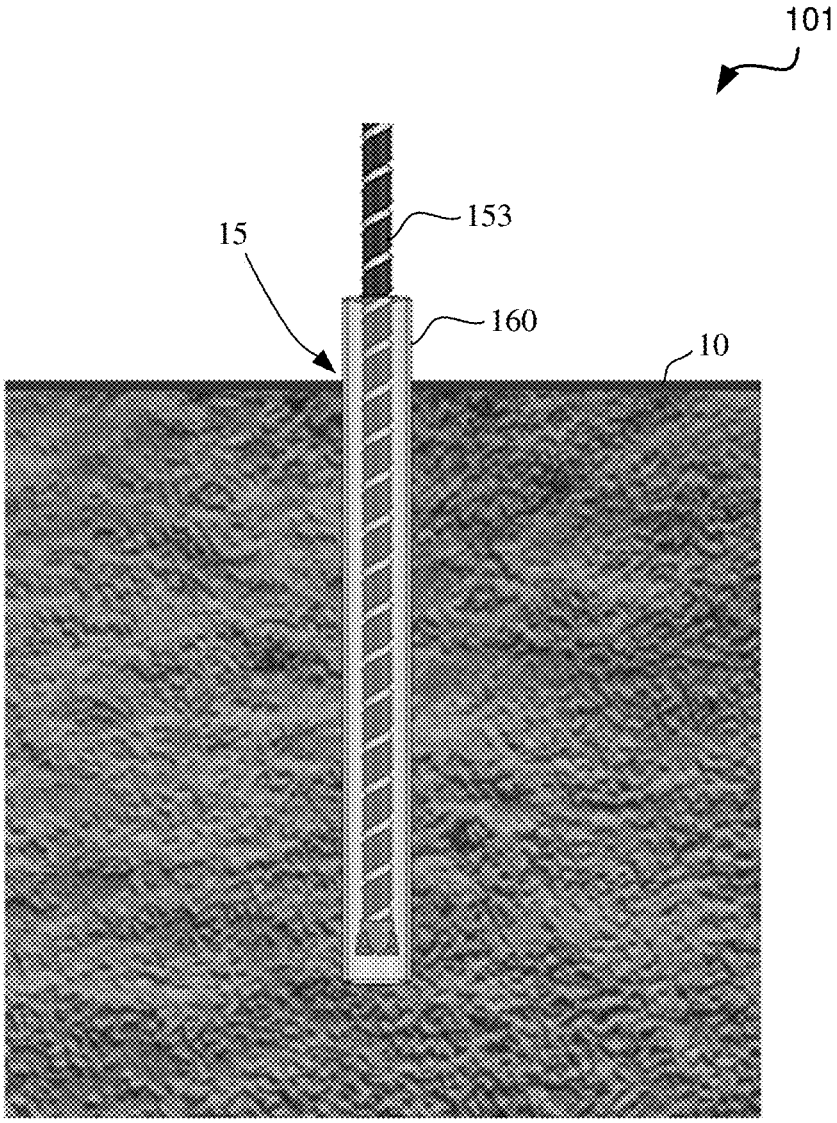
FIG. 1C is a close-up view of an anchoring element inserted into a casing in the seafloor in accordance with various embodiments.

FIG. 1C illustrates a close-up view of another environment 101 in which an anchoring element 153 is inserted into a casing 160 in the seafloor 10 in accordance with various embodiments. In various embodiments, a casing 160 may be inserted into the seafloor prior to drilling-in or inserting the anchoring element 153. In this way, drilling the anchoring element into the seafloor may be performed after the casing 160 has been inserted into the seafloor. The casing 160 may be drilled and/or hammered into the seafloor prior to inserting the anchoring element 153. A length of the casing may be longer or shorter than that of the anchoring element 153 depending on the application. In some embodiments, the casing 160 may be shorter than the anchoring element 153, such that the casing 160 is configured to extend only through harder layers of the seafloor and the anchoring element 153, once completely buried, is configured to extend beyond the casing 160. In this way, the anchoring element 153 may still need to be drilled beyond the depth of the casing 160. In addition, although the casing 160 is illustrated as not being fully buried in the seafloor 10, alternatively a top of the casing 160 may be flush or below the upper layers of the seafloor.

FIGS. 2A-2F illustrate a subsea grout assembly 140 in accordance with various embodiments. The subsea grout supply assembly 140 may include a variable volume grout storage chamber 216, at least one paddle (see, paddles 311, 312 in FIG. 3), and a subsea grout pump 251. The variable volume grout storage chamber 216 may be configured to expand from a collapsed configuration. In various embodiments, the variable volume grout storage chamber 216 in the collapsed configuration may receive dry grout. The dry grout may be added to the variable volume grout storage chamber 216 before the subsea grout assembly 140 is deployed under water. In the collapsed configuration, the variable volume grout storage chamber 216 may be configured to hold sufficient grout for installing one or more anchoring elements (e.g., 153). The variable volume grout storage chamber 216 may be sealed to maintain the dry grout stored therein dry until it is time to wet the grout and create a grout mixture. In this way, the variable volume grout storage chamber 216 may be configured to hold a water-tight seal at depths of 50 meters or more, and preferably over 100 meters. In this way, the subsea grout supply assembly 140 may be configured to withstand and be operated at ocean depths of 50 meters or more.

When appropriate, water may be injected into the variable volume grout storage chamber 216 to mix with the dry grout for creating a grout mixture. Water may be injected into the variable volume grout storage chamber 216 using one or more water injection ports 231, 232, 233 included in the variable volume grout storage chamber 216. The at least one paddle (e.g., 311, 312) may be configured to mix the dry grout and received water into a grout mixture. In this way, the at least one paddle (e.g., 311, 312) may generate an even grout mixture with the water well integrated with the dry grout. Once the grout mixture is fully mixed, the subsea grout pump 251 may be configured to pump the grout mixture out of the variable volume grout storage chamber 216 into an anchoring element at the seafloor.

In some embodiments, the variable volume grout storage chamber 216 may include distinct upper and lower sections 212, 214. The lower section 212 may be configured to be a dry grout storage section. The lower section 212 may be formed with rigid side walls, forming a rigid structure that is more suitable for resisting undersea water pressures. In addition, the rigid side walls of the lower section 212 may be better suited to hold side water injection ports 232. The upper section 214 may be formed with a flexible bladder, which may be expanded and contracted as needed. For example, the upper section 214 may be compressed to a contracted configuration in which a top of the upper section 214 is closer to the lower section 212 than the top is when in an expanded configuration. The contracted configuration may coincide with the collapsed configuration of the variable volume grout storage chamber 216. The expanded configuration, which has a greater inner volume than the collapsed configuration, may coincide with a mixing configuration in which the grout mixture is being mixed. A portion of the upper section 214, such as the top, may be fixed to an elevator 222 that is configured to move up and down vertically in the orientation shown in FIGS. 1A, 1B, 2A, 2C-2E, 3, 4A-4C, and 5B. By moving up, the elevator 222 may expand the variable volume grout storage chamber 216 or at least the upper section 214 thereof. By moving down, the elevator 222 may contract the variable volume grout storage chamber 216 or at least the upper section 214 thereof. In various embodiments, the elevator 222 may be formed as a top plate extending horizontally and sealing off the top of the variable volume grout storage chamber 216. Thus, a water-tight seal may be provided between upper edges of the upper section 214 and the elevator 222. Similarly, a water-tight seal may be provided between a bottom plate and a bottom of the lower section 212. The bottom plate may extend horizontally and seal off a bottom of the variable volume grout storage chamber 216. In contrast to the elevator 222, the bottom plate may keep a fixed position relative to a structural chassis 213 of the subsea grout supply assembly 140.

Alternatively, the variable volume grout storage chamber 216 may not include a rigid lower section, but rather include one continuous bladder, which may be compressed to various degrees to provide variable collapsed configurations. In this way, the bladder of the variable volume grout storage chamber 216 may be collapsed to almost any level of dry grout held within the variable volume grout storage chamber 216 and later expanded for the mixing process.

The subsea grout supply assembly 140 may additionally include a dry grout fill hatch 211 located at the top of the variable volume grout storage chamber 216 for adding dry grout to the variable volume grout storage chamber 216. Opening the hatch 211 and adding dry grout may be done before the subsea grout supply assembly 140 is deployed to the seafloor. The subsea grout supply assembly 140 may include a structural chassis 213 that may serve as a frame and support for various components of the subsea grout supply assembly 140. The subsea grout supply assembly 140 may also include elevator control cylinders 221 that control the movement of the elevator 222, which expands and contracts the variable volume grout storage chamber 224. The variable volume grout storage chamber 224 may be deployed to the seafloor in the fully collapsed (i.e., contracted) configuration, and expands during the grout mixture process. A Linear Variable Differential Transformer (LVDT) 223 may be used to measure the displacement of the elevator to determine a volume of the variable volume grout storage chamber 224 before, during, and/or after it changes configurations.

The variable volume grout storage chamber 216 may include one or more water injection ports 231, 232, 233 configured to receive water for mixing with the dry grout. For example, the variable volume grout storage chamber 216 may include upper water injection ports 231 disposed on a top-side of the variable volume grout storage chamber 216, which are configured to receive water for combining with the dry grout as part of the mixing procedure. Additionally or alternatively, the variable volume grout storage chamber 216 may include lower water injection ports 233 disposed on a bottom-side of the variable volume grout storage chamber 216. As a further addition or alternative, the variable volume grout storage chamber 216 may include side water injection ports 232 disposed on one or more lateral sides of the variable volume grout storage chamber 216. Together and/or individually, the water injection ports 231, 232, 233 may be configured to properly disperse water within the variable volume grout storage chamber 216 and properly saturate the dry grout for forming a grout mixture with an appropriate hydration level.

Figure 2E:
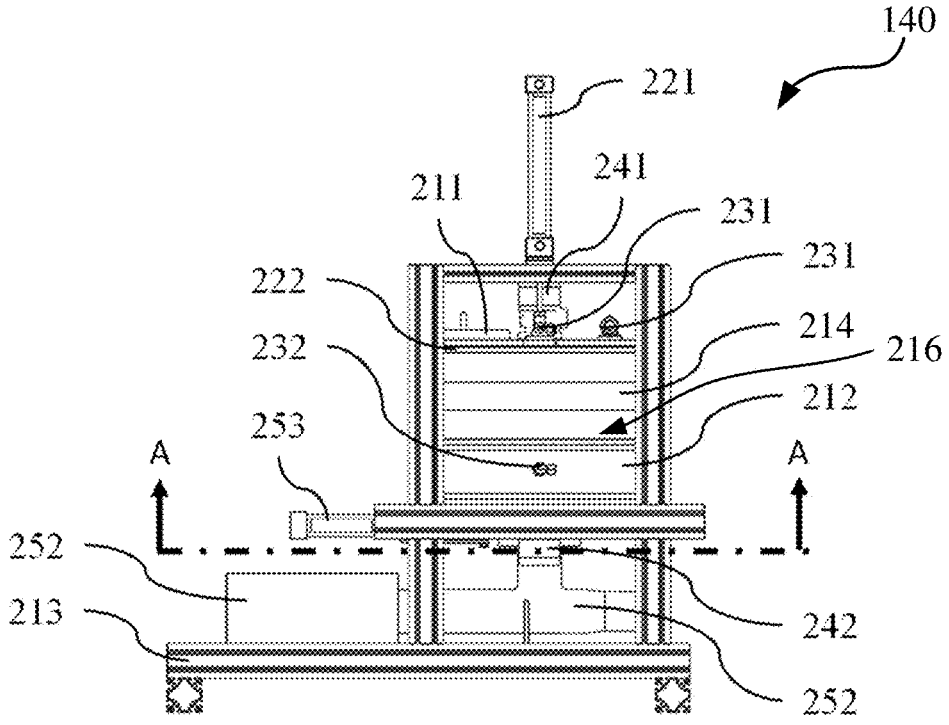
FIG. 2E is a left view of the subsea grout supply assembly of FIGS. 2A-2D, in accordance with various embodiments.
Figure 2F:
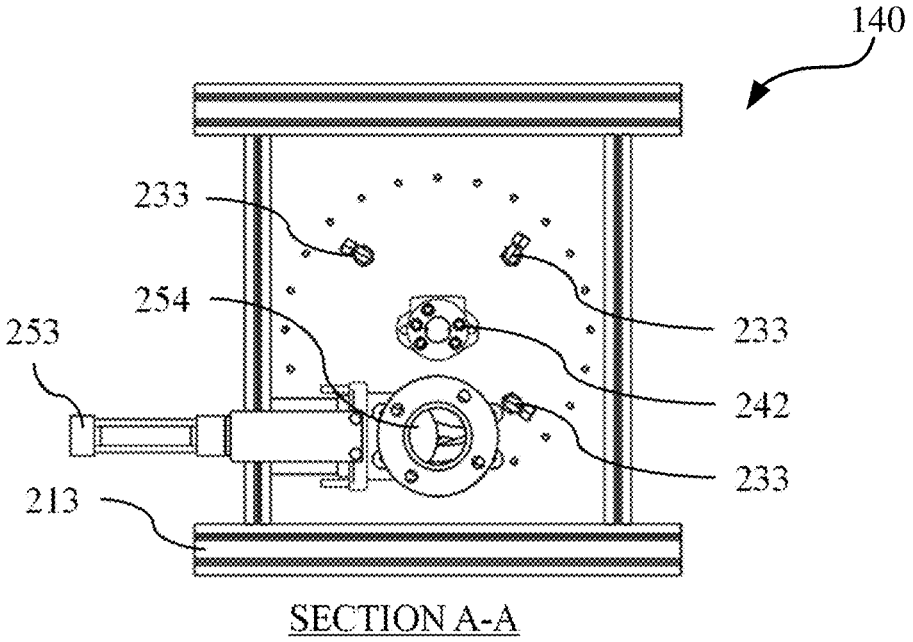
FIG. 2F is a cross-sectional bottom view of a portion of the subsea grout supply assembly of FIGS. 2A-2E, in accordance with various embodiments.

FIG. 2F illustrates a section view at A-A in FIG. 2E, illustrating the bottom view of a portion of the subsea grout supply assembly 140. A gate valve 254 may be included above the grout pump 251, which may be used to contain the grout within the variable volume grout storage chamber (e.g., 216) during deployment and mixing operations. Once mixing is completed, pumping of the grout mixture may begin. A gate valve actuator 253 may be used to open and close the gate valve 254.

Figure 3:
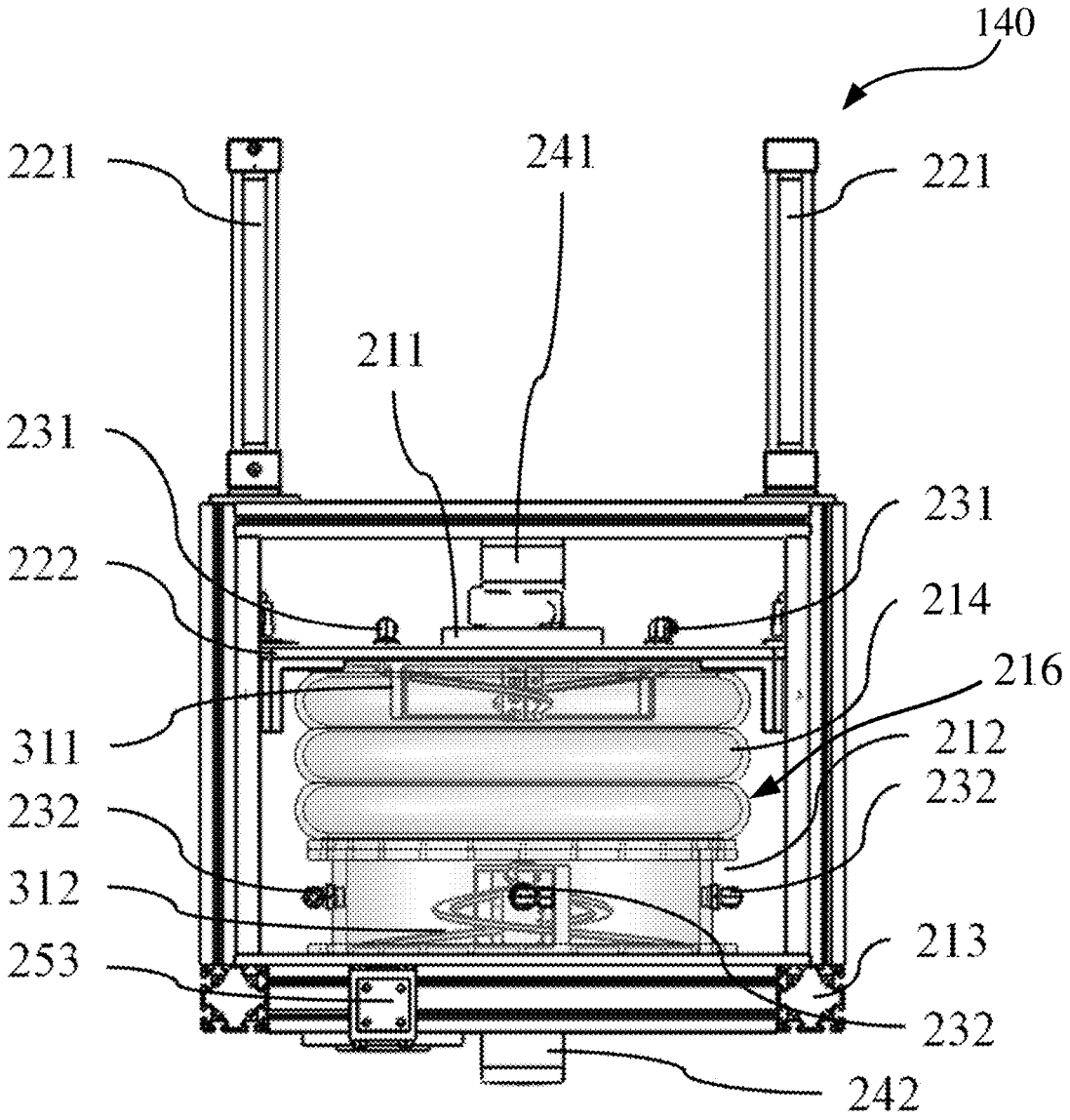
FIG. 3 is a front view of a subsea grout assembly with a partially transparent variable volume grout storage chamber in accordance with various embodiments.

FIG. 3 illustrates a semi-transparent view of the variable volume grout storage chamber 224 of the subsea grout plant 140 in accordance with various embodiments. As shown, at least one paddle 311, 312 may be disposed inside the variable volume grout storage chamber 224. An upper grout mixing paddle 311 may be disposed at a top of the variable volume grout storage chamber 224 and a lower grout mixing paddle 312 may be disposed at a bottom of the variable volume grout storage chamber 224. Alternatively, the variable volume grout storage chamber 224 may include only one grout mixing paddle, such as the lower grout mixing paddle 312. The variable volume grout storage chamber 224 may be configured such that in the collapsed configuration (i.e., the configuration with the shortest vertical profile) the variable volume grout storage chamber 224 still maintains sufficient room for the upper grout mixing paddle 311. These paddles are driven by the upper and lower mixing motors 241 and 242 and are used to mix the grout underwater after water is added through the water injection ports 231, 232, 233. Using multiple mixing paddles helps to properly mix the grout.

In various embodiments, the subsea grout supply assembly 140 may include at least one mixing motor configured to drive the at least one paddle 311, 312. In some embodiments, the at least one mixing motor may include an upper grout mixture motor 241 and a lower grout mixture motor 242. The upper and lower grout mixture motors 241, 242 may work in conjunction to mix and form a proper grout mixture at the seafloor. The upper grout mixture motor 241 may be configured to drive the upper grout mixing paddle 311. Similarly, the lower grout mixture motor 242 may be configured to drive the lower grout mixing paddle 312. One or both of the upper and lower grout mixture motors 241, 242 may be powered by the power supply (e.g., 110). Alternatively, the at least one paddle 311, 312 may be driven by the HPU (e.g., 120).

The subsea grout pump 251 may be driven by a grout pump motor 252, which may be fixedly secured to the structural chassis 213. For example, the subsea grout pump 251 and the grout pump motor 252 may be located at the bottom of the subsea grout supply assembly 140 to take advantage of gravity when pumping the grout mixture through the grout supply line (e.g., 155) to the subsea drill rig (e.g., 150), and particularly the drill head (e.g., 152) for setting the anchoring element (e.g., a micropile) into the seafloor (e.g., 10) after drilling is finalized. Alternatively, the subsea grout pump 251 may be driven by the HPU (e.g., 120).

Figure 4C:
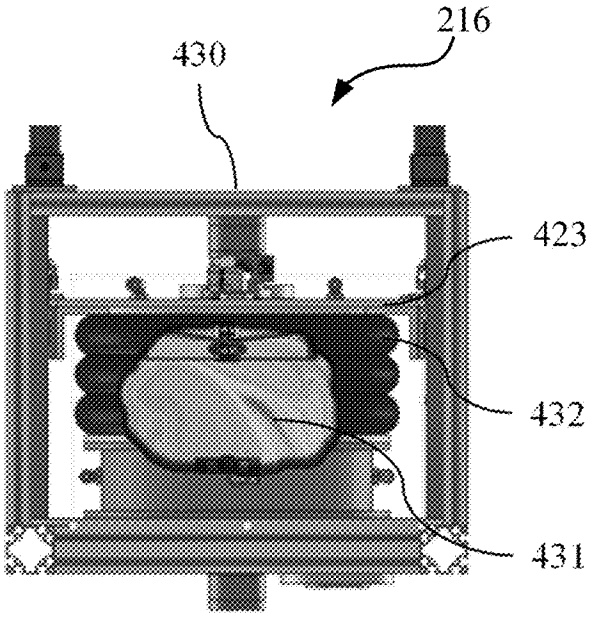
FIGS. 4A-4C are section views of a variable volume grout storage chamber, showing a bladder expansion and grout mixture process in accordance with various embodiments.
Figure 4B:
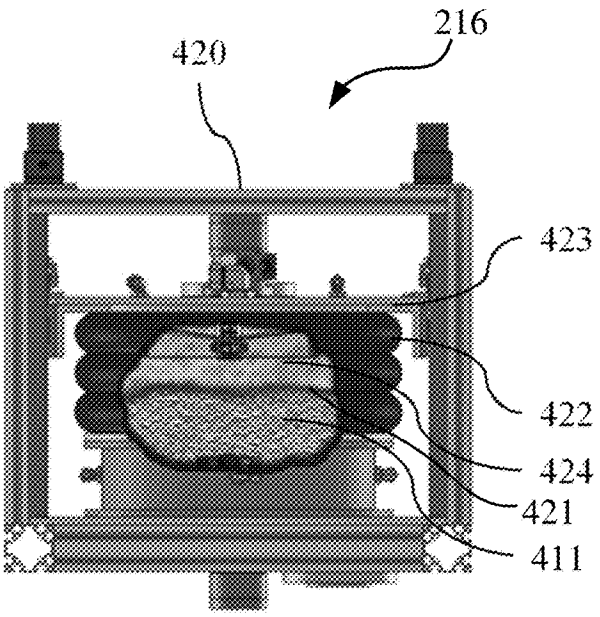
Figure 4A:
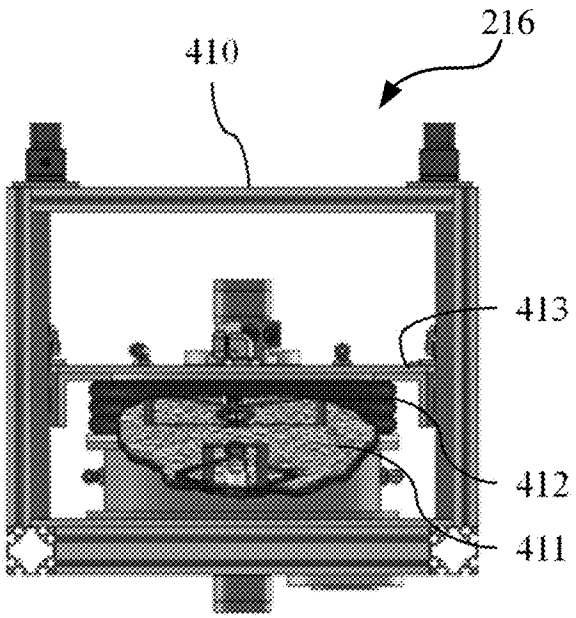

FIGS. 4A-4C illustrate section views of the variable volume grout storage chamber 216 in various configurations in accordance with various embodiments. FIG. 4A illustrates a deployment configuration 410, in which the elevator (e.g., 222) may be in a lower-most position 413, and the upper section (e.g., 214) is in a fully collapsed configuration 412. The dry grout 411 may be stored within the variable volume grout storage chamber 216 in the fully collapsed configuration 412 during deployment to the seafloor.

FIG. 4B illustrates a water injection configuration 420 in which the elevator (e.g., 222) has be raised to an upper position 423 to expand the variable volume grout storage chamber (e.g., 216), or at least the upper section (e.g., 214), to a fully expanded configuration 422. The fully expanded configuration 422 makes room for the volume of water 424 added to the variable volume grout storage chamber (e.g., 216). As the water 424 is initially injected into the variable volume grout storage chamber (e.g., 216), other than a small region of partially mixed grout 421, where the dry grout 411 and water 424 meet, the remainder of the water 424 may not automatically mix with the dry grout 411. Thus, FIG. 4B illustrates the water 424 not yet properly mixed into the dry grout 411.

FIG. 4C illustrates a grout mixing configuration 430 in which the elevator (e.g., 222) remains in the upper position 423, and the variable volume grout storage chamber (e.g., 216) is in a fully expanded configuration 432. The variable volume grout storage chamber (e.g., 216) may have a slightly larger volume in the mixing configuration 430 than in the water injection configuration (e.g., 420) to make room for mixing and expanding grout. Once the water and dry grout are fully mixed to the proper consistency, which may be measured by a predetermined mixing time) the grout mixture 431 may be ready to send to the subsea drill rig (e.g., 150).

Figure 5:
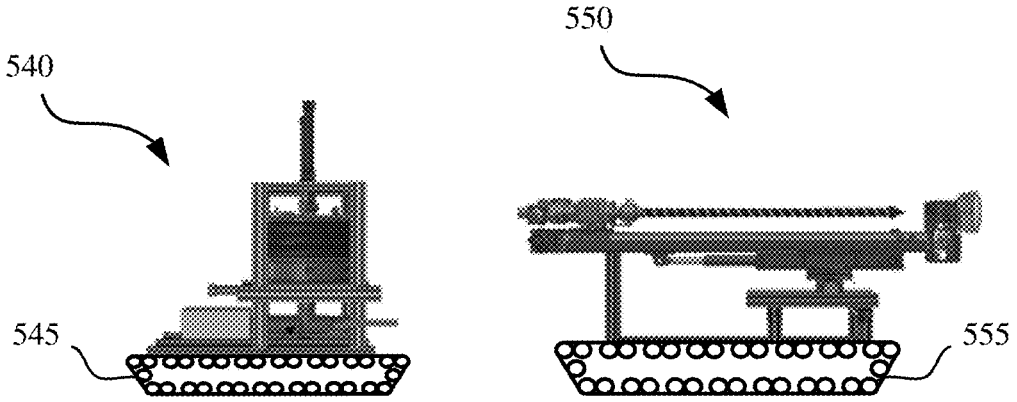
FIG. 5 is a side view of a mobile subsea anchorage installation system in accordance with various embodiments.

FIG. 5 illustrates a mobile version of elements of a subsea anchorage installation system in accordance with some embodiments. In particular, FIG. 5 illustrates a mobile subsea grout supply assembly 540 and a mobile subsea drill rig 550, which are each configured to be self-propelled subsea. For example, each of the mobile subsea grout supply assembly 540 and a mobile subsea drill rig 550 may include a continuous track-type vehicle propulsion system 545, 555, running on a continuous band of treads or track plates driven by two or more wheels. The continuous track-type vehicle propulsion system 545, 555 may be driven by an onboard motor.

Figure 6:
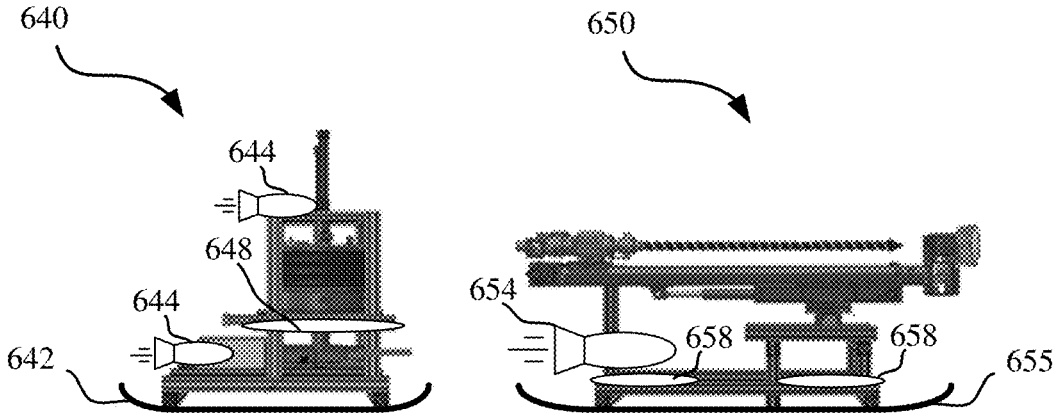
FIG. 6 is a side view of another mobile subsea anchorage installation system in accordance with various embodiments.

FIG. 6 illustrates another mobile version of elements of a subsea anchorage installation system in accordance with some embodiments. In particular, FIG. 6 illustrates a mobile subsea grout supply assembly 640 and a mobile subsea drill rig 650, which are each configured to be self-propelled subsea. For example, each of the mobile subsea grout supply assembly 640 and a mobile subsea drill rig 650 may include one or more skis or a sled-type bottom 642, 655 configured to help the assemblies slide along the seafloor. In addition, each of the mobile subsea grout supply assembly 640 and a mobile subsea drill rig 650 may include thrusters 644, 654 for propelling the assemblies along the seafloor. Further, each of the mobile subsea grout supply assembly 640 and a mobile subsea drill rig 650 may include buoyance control devices 648, 658 configured to help the mobile subsea grout supply assembly 640 and a mobile subsea drill rig 650 achieve a positive, neutral, and/or negative buoyancy.

Figure 7:
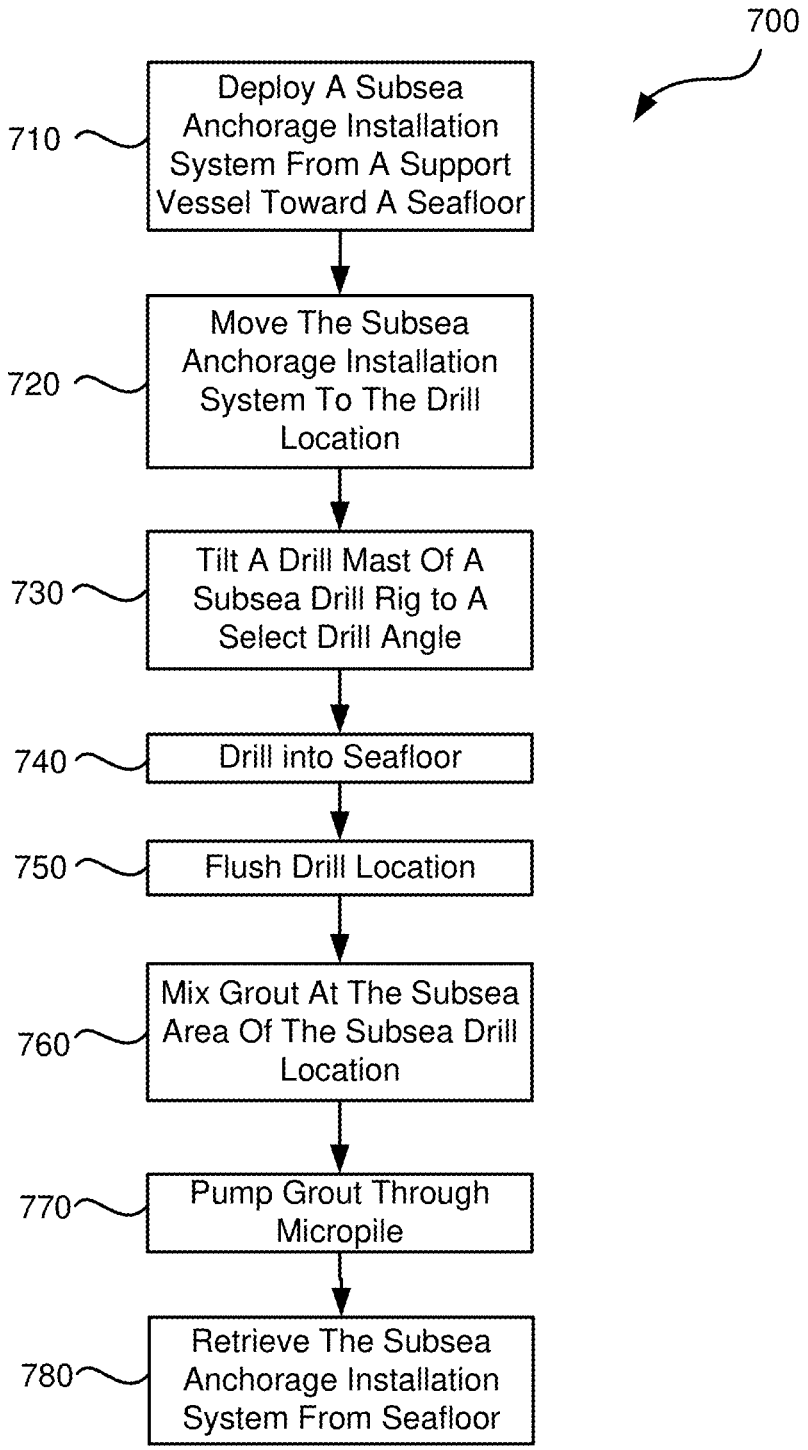
FIG. 7 is a process flow diagram of a method of installing micropiles in the seafloor in accordance with various embodiments.

FIG. 7 illustrates an embodiment method 700 of securing an anchoring element to the seafloor, in accordance with various embodiments as described above with reference to FIGS. 1A-6. With reference to FIG. 7, the method 700 and the operations thereof may be performed using a subsea anchorage installation system 100 configured to secure an anchoring element to a seafloor as described herein. For example, the method 700 and the operations thereof may be performed using a subsea grout supply assembly (e.g., 140, 540, 640). In addition, the method 700 and the operations thereof may be performed using a subsea drill rig (e.g., 150, 550, 650) and/or a plume capture assembly (e.g., 130). The operations of the method 700 may be controlled by an operator, performed by a processor of a control system, or a combination thereof.

The method 700 may include deploying a subsea anchorage installation system from a support vessel toward a seafloor in block 710. For example, the subsea grout supply assembly (e.g., 140) may be lowered from a surface ship using a crane or davit on the deck of the ship. The lowering process may position the subsea grout supply assembly in the general location of the more specific drill location (e.g., 15). In some embodiments, a subsea drill rig (e.g., 150, 550, 650) may also be deployed from the support vessel toward the seafloor. In addition, in some embodiments, a plume capture assembly may further be deployed from the support vessel toward the seafloor. Deploying the subsea grout supply assembly, the subsea drill rig, and/or the plume capture assembly may occur together or separately.

In block 720, the subsea anchorage installation system may be moved to the drill location (e.g., 15). In some embodiments, the subsea anchorage installation system may be positioned with external support equipment. Alternatively, the anchorage installation system may use onboard propulsion to move or propel all or some components of the anchorage installation system to the drill location. For example, the subsea anchorage installation system may have its own method of transportation for it to travel subsea to the drill location. Some embodiments may include using wheels or treads in conjunction with drive motors to move along the seafloor. Other embodiments may include thrusters and buoyancy control to travel subsea.

In block 730, the drill mast (e.g., 151) of a subsea drill rig may be tilted to a select drill angle. Tilting of the drill mast may be controlled to place the drill mast and a corresponding drill head (e.g., 152) and anchoring element (e.g., micropile 153) at an appropriate drilling angle. Various embodiments may include a hydraulic cylinder to raise the drill mast.

In block 740, the drill head (e.g., 152) of a subsea drill rig may begin to drill the anchoring element (e.g., micropile 153) into the seafloor.

In block 750, the plume hood (e.g., 154) of a subsea drill rig may be used to flush the drill location and remove most of the environmental sediment plume generated from drilling into the seafloor. Water may be pumped through a hollow interior of the anchoring element (e.g., micropile 153) to remove the sediment from the drill location. The plume hood may maintain negative pressure in order to capture the environmental sediment plume. The sediment and water mixture captured by the plume hood may be sent to a plume capture assembly (e.g., 130), which may be used to remove sediment and filter the water supply. The plume capture assembly (e.g., 130) may include an eductor (e.g., 131) and a water filter (e.g., 133) to remove sediment and filter the water supply. Also included in the plume capture assembly may be a water pump used to distribute the filtered water to other parts of the subsea anchorage installation system, such as the subsea grout supply assembly and/or the subsea drill rig.

In block 760, the subsea grout supply assembly (e.g., 140) may be used to combine and mix dry grout and water at the subsea area of the subsea drilling location (i.e., on the seafloor).

In block 770, the subsea grout supply assembly (e.g., 140) may pump the grout mixture to the subsea drill rig and through the anchoring element (e.g., micropile 153) to fill the drill cavity and secure the anchoring element in the seafloor.

In block 780, the subsea anchorage installation system may be retrieved from the seafloor using a support vessel. In particular, the subsea grout supply assembly (e.g., 140, 540, 640) may be retrieved by a surface ship using a crane or davit on the deck of the ship. Additionally, the subsea drill rig (e.g., 150, 550, 650) and/or the plume capture assembly (e.g., 130) may be retrieved by the surface ship using the crane or davit on the deck of the ship.

Figure 8:
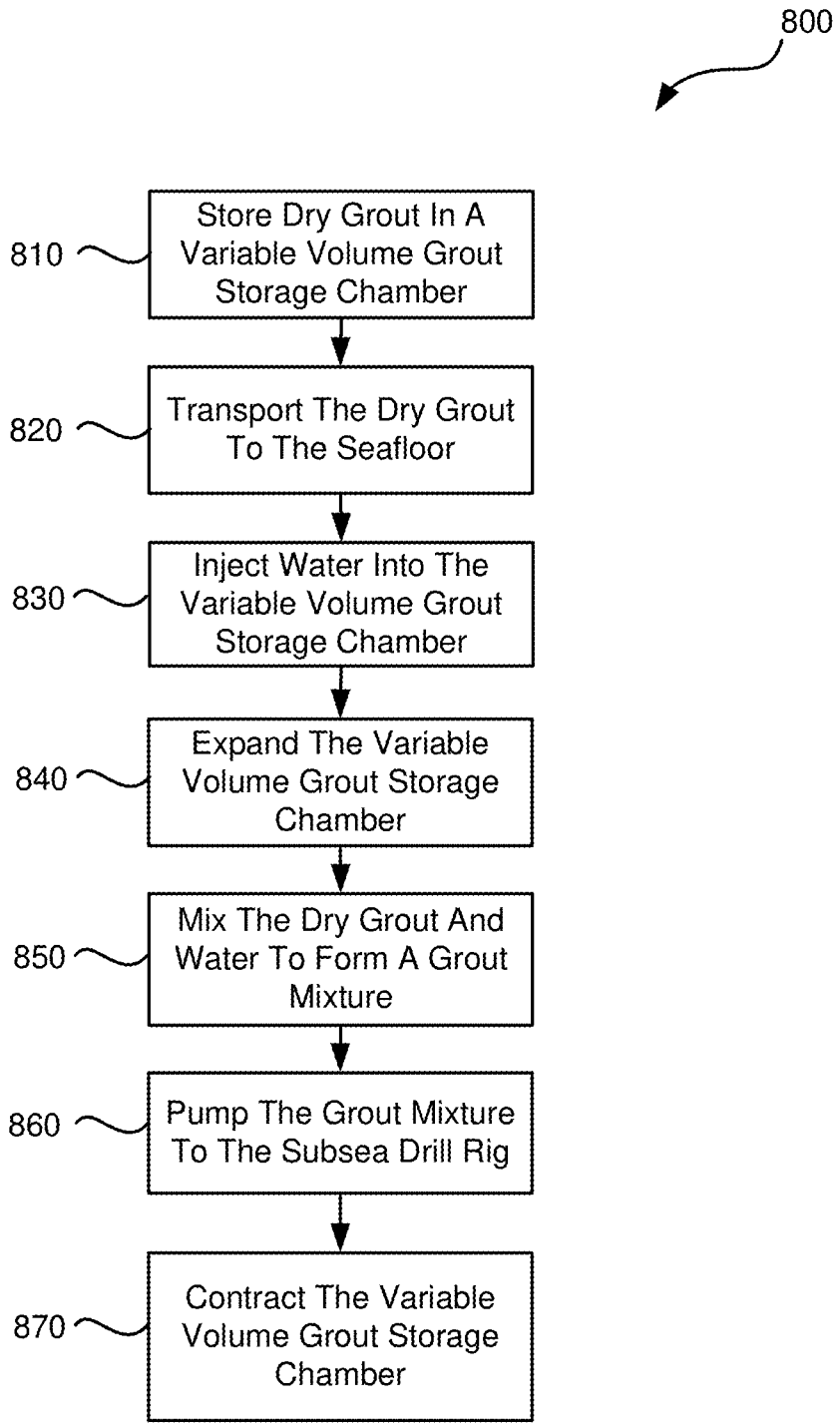
FIG. 8 is a process flow diagram of a method of supplying subsea grout in accordance with various embodiments.

FIG. 8 illustrates an embodiment method 800 of subsea grout supply, in accordance with various embodiments as described above with reference to FIGS. 1A-6. The operations of the method 800 may be performed using a subsea anchorage installation system 100 configured to secure an anchoring element to a seafloor. For example, the method 800 and the operations thereof may be performed using a subsea grout supply assembly (e.g., 140, 540, 640). In addition, the method 800 and the operations thereof may be performed using a subsea drill rig (e.g., 150, 550, 650) and/or a plume capture assembly (e.g., 130). The operations of the method 800 may be controlled by an operator, performed by a processor of a control system, or a combination thereof.

In block 810, dry grout may be stored in a variable volume grout storage chamber (e.g., 216). In some embodiments, a flexible bladder 214 may form all or part of the variable volume grout storage chamber. In addition, the variable volume grout storage chamber may be maintained in a compressed configuration by an elevator (e.g., 222) configured to selectively change a configuration of the variable volume grout storage chamber from the compressed configuration.

In block 820, the dry grout may be transported to the seafloor within the variable volume grout storage chamber (e.g., 216). For example, the subsea grout supply assembly (e.g., 140, 540, 640) may be lowered from the support vessel to the seafloor.

In block 830, water may be injected into the subsea grout supply assembly (e.g., 140, 540, 640) while on the seafloor. For example, water may be injected into the variable volume grout storage chamber (e.g., 216) through water injection ports (e.g., 231, 232, 233). The injected water is used to saturate the dry grout for the grout mixing procedure that is performed on the seafloor. In some embodiments, seawater from the surrounding water to the subsea grout supply assembly may be used to mix the grout mixture. Other embodiments may use water other than seawater (e.g., potable water) that is stored on the micropile rig for grout mixture. Water injection ports may be placed in various locations on the subsea grout supply assembly to properly saturate the dry grout mixture.

In block 840, the variable volume grout storage chamber (e.g., 216) may be expanded. For example, a control system may activate the elevator (e.g., 222) to expand the variable volume grout storage chamber to make room for the water added to the grout mixture.

In block 850 the dry grout and the water in the variable volume grout storage chamber may be mixed. For example, the upper and/or lower mixing motors (e.g., 241, 242) may drive mixing paddles (e.g., 311, 312) to mix and agitate the grout after the water is added to the dry grout. Mixing may continue until the grout is properly mixed and the grout is saturated. The mixing process may be a timed process in order to ensure proper mixing to the correct grout consistency.

In block 860 the grout mixture produced from the mixing in block 840 may be pumped to the subsea drill rig (e.g., 150, 550, 650). For example, a gate valve (e.g., 254) may be opened and a grout pump (e.g., 252) may begin pumping the properly mixed grout mixture to the subsea drill rig and eventually through the hollow portion of the anchoring element (e.g., micropile 153) to fill the drill cavity and secure the anchoring element in the seafloor.

In block 870 the variable volume grout storage chamber (e.g., 216) may be contracted as the grout mixture is pump out. For example, as the grout mixture is pumped out of the variable volume grout storage chamber, the elevator (e.g., 222) may be lowered to collapse the variable volume grout storage chamber, or at least the upper portion (e.g., 214).

Various embodiments enable anchoring elements, such as micropiles, to be installed on the seafloor without additional support equipment or grout pumping from a surface support vessel. This has the potential to support deeper water installations and lower cost than existing subsea anchoring installation methods.

In addition, the subsea drill rig of various embodiments may have all supporting equipment needed to be self-sufficient and perform all the tasks needed to locate itself at the drill location, drill the anchoring element (e.g., a micropile) into the seafloor, capture and filter out environmental sediment plume generated during the drilling procedure, mix the grout at the seafloor, pump the grout mixture to secure the anchoring element in the seafloor and fill the drill cavity.

The preceding description of the disclosed embodiments is provided to enable any person skilled in the art to make or use the claims. Various modifications to these embodiments will be readily apparent to those skilled in the art, and the generic principles defined herein may be applied to other embodiments without departing from the scope of the claims. Thus, the claims not intended to be limited to the embodiments shown herein but is to be accorded the widest scope consistent with the language of the following claims and the principles and novel features disclosed herein.

What is claimed is:

1. A subsea anchorage installation system, comprising:

a variable volume grout storage chamber configured to transport dry grout therein;

a water injection port configured to enable water to be injected into the variable volume grout storage chamber for mixing with the dry grout to form a grout mixture after the variable volume grout storage chamber is under water, wherein the variable volume grout storage chamber is configured to expand from a collapsed configuration as water is injected through the water injection port; and a paddle disposed in the variable volume grout storage chamber, wherein the paddle is configured to mix the dry grout and water received through the water injection port into the grout mixture.

2. The subsea anchorage installation system of claim 1, wherein the variable volume grout storage chamber comprises upper and lower sections, wherein the upper section is formed with a flexible bladder and the lower section is formed with rigid side walls, and wherein only the upper section of the upper and lower sections is configured to expand and contract.

3. A subsea anchorage installation system, comprising:

a variable volume grout storage chamber configured to transport dry grout therein;

a water injection port configured to enable water to be injected into the variable volume grout storage chamber for mixing with the dry grout to form a grout mixture after the variable volume grout storage chamber is under water, wherein the variable volume grout storage chamber is configured to expand from a collapsed configuration as water is injected through the water injection port; and a subsea drill rig comprising:

a drill mast configured to be raised to a select drill angle;

a drill head coupled to the drill mast, wherein the drill head is configured to drill an anchoring element into the seafloor at a drill location; and a plume hood coupled to the drill head, wherein the plume hood is configured to collect sediment generated in association with drilling the anchoring element into the seafloor.

4. The subsea anchorage installation system of claim 3, further comprising:

a plume capture assembly comprising:

an eductor configured to remove sediment particulates flushed from the drill location of the anchoring element;

a water filter configured to remove sediment and particulates from a water stream; and a water pump configured to direct the water stream to pass through the water filter.

5. The subsea anchorage installation system of claim 3, wherein the water injection port is configured to inject seawater from surrounding water into the dry grout at the drill location.

6. The subsea anchorage installation system of claim 3, wherein the water injection port is configured to inject fresh water supplied from a subsea container into the dry grout to form the grout mixture at the drill location.

7. The subsea anchorage installation system of claim 3, wherein the variable volume grout storage chamber comprises upper and lower sections, wherein the upper section is formed with a flexible bladder and the lower section is formed with rigid side walls, and wherein only the upper section of the upper and lower sections is configured to expand and contract.

8. The subsea anchorage installation system of claim 3, further comprising:

a paddle disposed in the variable volume grout storage chamber, wherein the paddle is configured to mix the dry grout and water received through the water injection port into the grout mixture; and a mixing motor configured to drive the paddle.

9. The subsea anchorage installation system of claim 1, wherein the variable volume grout storage chamber is configured to withstand and be operated at ocean depths of fifty meters or more.

10. The subsea anchorage installation system of claim 1, further comprising self-propulsion mechanisms configured to move the variable volume grout storage chamber after the variable volume grout storage chamber is under water.

11. The subsea anchorage installation system of claim 10, wherein the self-propulsion mechanisms comprise motors and treads or wheels.

12. The subsea anchorage installation system of claim 10, wherein the self-propulsion mechanisms comprise thrusters and buoyancy control.

13. The subsea anchorage installation system of claim 1, further comprising a mixing motor configured to drive the paddle.

14. The subsea anchorage installation system of claim 1, further comprising:

a subsea grout pump configured to pump the grout mixture out of the variable volume grout storage chamber into an anchoring element.

15. A method of installing anchoring elements in a seafloor, comprising:

transporting dry grout to the seafloor in a variable volume grout storage chamber, wherein the transported dry grout is maintained dry at the seafloor within the variable volume grout storage chamber; and mixing the transported dry grout and water to form a grout mixture within the variable volume grout storage chamber at the seafloor.

16. The method of claim 15, further comprising:

injecting water into the variable volume grout storage chamber while expanding the variable volume grout storage chamber.

17. The method of claim 16, wherein injecting water into the variable volume grout storage chamber comprises injecting seawater from an area around a drilling location at the seafloor into the variable volume grout storage chamber.

18. The method of claim 16, wherein injecting water into the variable volume grout storage chamber comprises injecting fresh water that is other than seawater.

19. The method of claim 15, further comprising:

contracting the variable volume grout storage chamber.

20. The method of claim 15, further comprising:

drilling an anchoring element into the seafloor at a drill location to a selected depth; and pumping the grout mixture from the variable volume grout storage chamber at the seafloor to a subsea drill rig at the drill location comprises such that the grout mixture is pumped into the anchoring element in response to drilling the anchoring element to the selected depth.

21. The method of claim 20, further comprising inserting a casing into the seafloor, wherein drilling the anchoring element into the seafloor comprises drilling the anchoring element into the seafloor in response to inserting the casing into the seafloor, and wherein the anchoring element is inserted through the casing to be drilled into the seafloor.

* * * * *